United States Patent [19]

Kashio

[11] 4,064,687

[45] Dec. 27, 1977

[54] DIGITAL DISPLAY TYPE TIMEPIECE

[75] Inventor: Toshio Kashio, Tokyo, Japan

[73] Assignee: Casio Computer Co., Ltd., Tokyo, Japan

[21] Appl. No.: 602,112

[22] Filed: Aug. 5, 1975

[30] Foreign Application Priority Data

Aug. 10, 1974 Japan ..... 49-91890

[51] Int. Cl.[2] ..... G04B 19/24; G04C 21/32; G08B 23/00

[52] U.S. Cl. ..... 58/4 A; 58/58; 58/153; 340/324 M

[58] Field of Search ..... 58/4 A, 23 R, 50 R, 58/58, 153, 127 R; 340/324 R, 324 M, 336

[56] References Cited

U.S. PATENT DOCUMENTS

| | | | |
|---|---|---|---|
| 3,802,182 | 4/1974 | Fujita | 58/50 R |
| 3,839,856 | 10/1974 | Dargent | 58/4 A |
| 3,971,012 | 7/1976 | Morokawa et al. | 58/50 R |
| 3,992,871 | 11/1976 | Numabe | 58/39.5 |

*Primary Examiner*—Edith S. Jackmon
*Attorney, Agent, or Firm*—Flynn & Frishauf

[57] ABSTRACT

A digital display type timepiece has a 2-digit decimal numerical figure display section divided in a manner to correspond to an hour and a minute display with a dividing display mark therebetween. A month and date-of-month display can also be made, by switching, on the same decimal display section. A time display is effected on the decimal display section by count outputs of time counters adapted to be driven by reference signals of an oscillator. During the time display, the display mark is flashed in a predetermined second cycle by the reference signal of the oscillator. The date display is made on the same display section by count outputs of date-of-month counters adapted to be driven by carry signals of the time counters. When switching is made from the time display to the date display, the display mark is correspondingly switched into a state different from the flashed state.

7 Claims, 3 Drawing Figures

DIGITAL DISPLAY TYPE TIMEPIECE

SUMMARY OF THE INVENTION

This invention relates to a digital display type timepiece capable of effecting a switch between a time display and a date display on the same and in particular to a digital display type timepiece capable of immediately discriminating between a date display and a time display by dependence upon the display state of a specific display mark.

A digital display type timepiece has a time display section at which a time display is effected by decimal numerical figures, the time display section usually constituting a 2-digit decimal numerical figure display section divided in a manner to correspond to an hour and a minute display. Where a date display is effected, together with a time display, on the face of the timepiece, extra space is necessary. In the case of a small-sized timepiece such as a wrist watch in particular, it is necessary that the area of the time display section be set to be great enough to gain a ready time reading. It is, however, difficult to provide an additional date display section etc. in a limited face area of the small-sized timepiece. In order to avoid such a disadvantage attempts have been made to effect a date display on a time display section in the face of the timepiece. That is, the time display is switched to the date display by giving a date display instruction. Since in this case the date display is made, like the time display, by the same numerical figures, it is often difficult to distinguish between the date display and the time display.

This invention provides a digital display type timepiece free from the above-mentioned drawback, which is capable of clearly distinguishing between a time display and a date display which are selectively made on the same digital numerical figure display section in the face of the timepiece.

According to this invention there is provided a digital display type timepiece comprising oscillator means for generating reference signals; time counting means for counting the reference signals for time display, means for effecting a date counting by counting carry signals from said time counting means; time display means adapted to always receive output signals from said time counting means so as to effect a time display at a 2-digit decimal numerical figure display section divided in a manner to correspond to an hour and a minute display with a dividing display mark therebetween; control means for flashing said display mark in a predetermined second cycle; switching means for making a switch from at least a minute display to a day-of-month display; and means for switching said display mark from one state to another state by switching the switching means. According to this invention, when a time display is being effected by the display means, the display mark is flashed in a predetermined second cycle, for example, one second by the output of the oscillator. Where the time display is switched to the date display, the display mark is correspondingly switched from one state to another i.e. from the "flashed" state to a "continuously lighted" or "continuously extinguished" state, thereby clearly distinguishing between the time display and the date display.

DESCRIPTION OF THE PREFERRED EMBODIMENT

Figure 1:
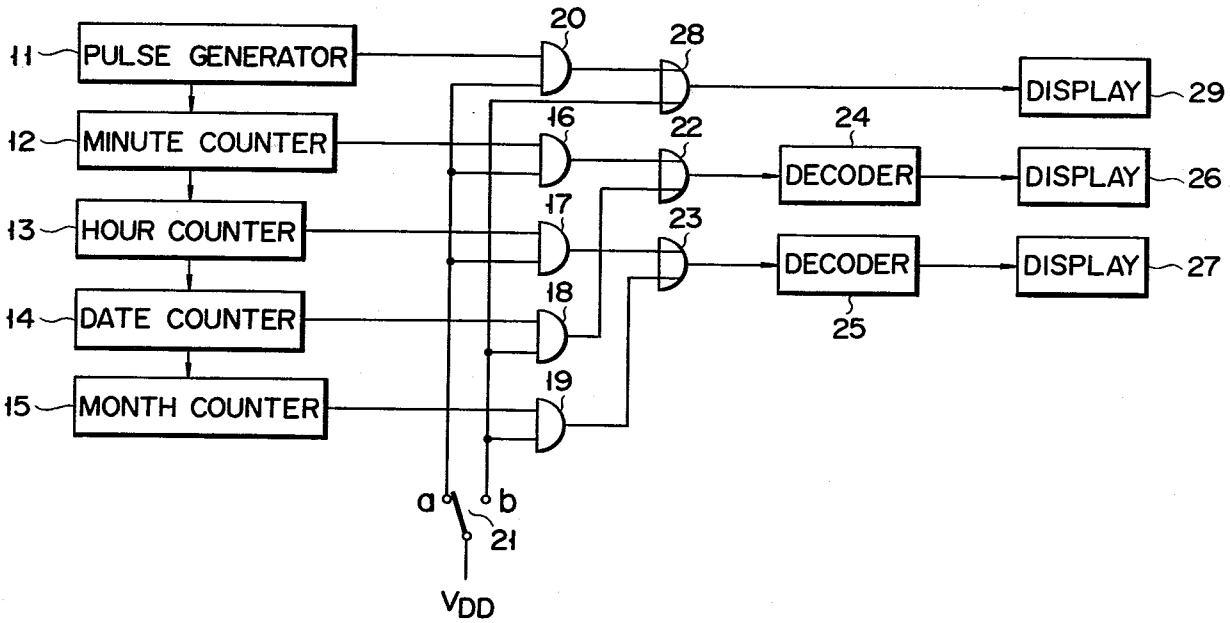
FIG. 1 shows a circuit arrangement of a timepiece according to one embodiment of this invention.

As shown in FIG. 1 a pulse generator 11 includes an oscillator (not shown) for generating a high frequency signal through, for example, a crystal oscillator and a frequency divider for frequency-dividing the high frequency signal, and is adapted to generate a 1p/sec (one pulse per second) clock signal and a 1p/min (one pulse per minute) clock signal. The pulse generator 11 delivers the 1p/min clock signal, as a count step signal, to a minute counter 12 constituting, for example, a scale-of-60 counter. As a result, the count value of the minute counter 12 corresponds to the time unit of "minutes." The minute counter 12 generates a carry signal at the rate of 60 counts i.e. for each 1-hour cycle. The carry signal of the minute counter 12 is coupled, as a count step signal, to an hour counter 13 which constitutes, for example, a scale-of-12 counter. In consequence, the count value of the hour counter 13 corresponds to the time unit of "hours." The hour counter 13 generates a carry signal for each 12 hour cycle which is coupled to a date counter 14 to cause the latter to be stepped. Since a day is 24 hours, the date counter 14 is stepped, an amount corresponding to a day, upon receipt of two carry signals from the hour counter 13. The date counter 14 can be constituted on a scale-of-31 base and, in this case, it delivers a carry signal in units of a day. Although the dates included in one month are varied, for example, in a range of 28 to 31, if the maximum count value of the date counter 14 can be arbitrarily selected so as to coincide with the number of days in a corresponding month, it is possible to obtain a carry signal when one month is replaced with another. The carry signal of the date counter 14 is coupled to a month counter 15 to cause the latter to be stepped. That is, the minute and hour counters 12 and 13 constitute a time counting circuit, and the date and month counters 14 and 15 constitute a date counting circuit. The count signals of the counters 12, 13, 14 and 15 are coupled to AND circuits 16, 17, 18 and 19 respectively and the 1p/sec clock signal of the pulse generator 11 is supplied to an AND circuit 20.

A signal voltage V is applied as a gate signal to the AND circuits 16, 17 and 20 from a normally closed terminal *a* of a switch 21 adapted to be switched by a date display instruction and it is also applied as a gate signal to the AND circuits 18 and 19 from a normally open terminal *b* of the switch 21. The switch 21 is a common push botton adapted to be returned to the original position by a spring, but it may be made of a combination of a switching mechanism and binary counter. In either case, it provides an input for switching a display mark, to be later described, from one display state to another.

The outputs of the AND circuits 16 and 18 are coupled to an OR circuit 22 and the outputs of the AND circuits 17 and 19 are coupled to an OR circuit 23. The outputs of the OR circuits 22 and 23 are supplied to decoders 24 and 25, respectively. Display is made at display segments 26 and 27 by the decoders 24 and 25, the display segment 26 indicating a 2-digit decimal numerical figure expressed in units of a minute and the display segment 27 a 2-digit decimal numerical figure expressed in units of an hour. The output of the AND circuit 20 is supplied, together with the signal voltage V on the terminal *b* of the switch 21, to an OR circuit 28. A dividing display mark (:) is displayed, by the OR circuit 28, on a display segment 29.

Figure 2:
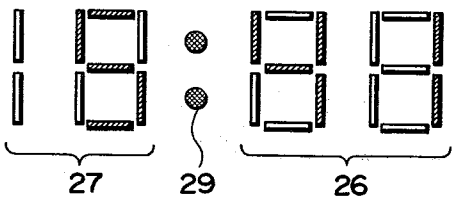

Suppose that, with the switch 21 in the state shown, the signal voltage V is being applied to the AND circuits 16, 17 and 20. Then, the count values of the counters 12 and 13 are coupled to the decoders 24 and 25, respectively, thereby indicating, for example, the time "41 minutes past five" as shown in FIG. 2. In this case, the dividing display mark is flashingly displayed on the display segment 29 situated between the minute display segment 26 and the hour display segment 27. The dividing display mark is flashed, in units of a second, on the display segment 29 upon receipt of the 1p/sec clock signal sent from the pulse generator 11 through the AND circuit 20. It will be sufficient only if the display mark is flashed in units of at least 1 second (for example, 2 seconds), indicating that a time counting operation is being effected.

Figure 3:
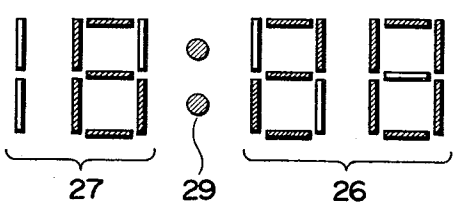
FIGS. 2 and 3, each, shows a display section in the face of the timepiece.

When the switch 21 is switched by the date indicating instruction each gate of the AND circuits 18 and 19 is opened, while the AND circuits 16, 17 and 20 are closed. As a result, the count signals of the counters 14 and 15 are coupled to the decoders 24 and 25 so that a date display is made, for example, in the form of "June 20th" as shown in FIG. 3. Since at the same time the signal on the terminal *b* of the switch 21 is applied to the OR circuit 28 during the date display instruction issuing period, the display mark is continuously lighted on the display segment 29, indicating that the time is not being displayed on the display segments 26 and 27. Switching may be made so that only the date of the month can be displayed on the corresponding segment 26. In this case a month display is not made on the display segment 27.

The mark may be either continuously lighted or continuously extinguished on the display segment 29. In the latter case, an output on the terminal *b* of the switch 21 is coupled through the AND circuit 20 direct to the display segment 29 so that the display mark is continuously extinguished on the display segment 29. In either case, it is possible to clearly distinguish between the time display and the date display by dependence upon the display state of the display mark on the display segment 29. A date display instruction can be given, for example, by a button etc., and in this case an immediate judgement can be made as to whether the date display is made or not. Although in the above-mentioned embodiment the colon (:) is used as the display mark, any other marks such as a dot, a bar (lateral or longitudinal) etc. may be arbitrarily selected as such. In this case, the bar is divided in its longitudinal direction into a plurality of parts and the parts of the bar may be lighted or extinguished in units of a second. The upper and lower dots of the colon display mark (:) may be alternatively lighted. In place of the month display, a date-of-week display can be made, together with the date-of-month display, on the display segments by converting the date of the week into an equivalent count value.

Although in the above-mentioned embodiment switching is made between the date display and the time display by manually operating the switch 21, a switching instruction can be given to a wrist watch for continuous display for a predetermined length of time, for example, by moving the user's hand so as to bring the watch into a predetermined position, imparting a striking impact to it, or moving the muscle of the user's arm. It is possible in this case to visually correctly distinguish between the time display and the date display even if switching is erroneously effected.

What is claimed is:

1. A digital display type timepiece comprising:

oscillator means for generating reference signals;

time counting means for counting the reference signals for time display;

means for effecting a date counting by counting carry signals from said time counting means;

means for normally receiving output signals from said time counting means, which signals represent the always changing time, so as to normally effect a time display at a 2-digit decimal numeral figure display section divided in a manner to correspond to an hour and a minute display with a dividing display mark therebetween;

a first control means for visually flashing said dividing display mark at a rate of one cycle per second while said means for normally receiving output signals is effecting the time display;

a manually operable switching means for effecting a switch from a time display to a date display by coupling the output of said date counting means to said decimal display section in place of the output of said time counting means; and a second control means for switching the complete display mark from its flashing state to another state different from its flashing state during the switching of said manually operable switching means to display the date, so as to visually distinguish between a date display and a time display.

2. A digital display type timepiece according to claim 1 in which said first switching means includes means for effecting a switch from a minute display to a date-of-month display.

3. A digital display type timepiece according to claim 1 in which said first switching means is adapted to effect a switch from an hour and minute display on said display section to a month and date-of-month display.

4. A digital display type timepiece according to claim 1 in which said display mark is provided in the form of a colon on said display section.

5. A digital display type timepiece according to claim 1 in which said display mark is so controlled that, when said manually operable switching means is switched to display the date, it is continuously lighted in its entirety.

6. A digital display type timepiece according to claim 1 in which said display mark is so controlled that, when said manually operable switching means is switched to display the date, it is continously extinguished in its entirety.

7. A digital display type timepiece according to claim 1 in which said display mark is so controlled that, when said manually operable switching means is switched to display the date, it ceases to flicker.

* * * * *

UNITED STATES PATENT AND TRADEMARK OFFICE

CERTIFICATE OF CORRECTION

PATENT NO. : 4,064,687

DATED : December 27, 1977

INVENTOR(S) : Toshio KASHIO

It is certified that error appears in the above-identified patent and that said Letters Patent are hereby corrected as shown below:

Column 4 (claim 1), line 31, change "complete" to --dividing--.

Signed and Sealed this

*Fourth* Day of *November 1980*

[SEAL]

*Attest:*

SIDNEY A. DIAMOND

*Attesting Officer*

*Commissioner of Patents and Trademarks*